US006200693B1

(12) United States Patent
Nakada et al.

(10) Patent No.: US 6,200,693 B1
(45) Date of Patent: Mar. 13, 2001

(54) WATER-BASED LIQUID TREATMENT FOR ALUMINUM AND ITS ALLOYS

(75) Inventors: Kazuya Nakada; Motoki Kawaguchi, both of Tochigi-ken; Kazuhiro Maeda, Saitama-ken, all of (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/424,356

(22) PCT Filed: May 22, 1998

(86) PCT No.: PCT/US98/09902

§ 371 Date: Nov. 22, 1999

§ 102(e) Date: Nov. 22, 1999

(87) PCT Pub. No.: WO98/52699

PCT Pub. Date: Nov. 26, 1998

(30) Foreign Application Priority Data

May 22, 1997 (JP) ..... 9-131859

(51) Int. Cl.[7] ..... B32B 15/00; C23C 22/48

(52) U.S. Cl. ..... 428/651; 106/14.14; 106/14.21; 148/247; 148/273; 148/275; 428/472; 428/628

(58) Field of Search ..... 428/651, 472, 428/628; 148/247, 273, 275; 427/435; 106/14.14, 14.21

(56) References Cited

U.S. PATENT DOCUMENTS

| | | | | |
|---|---|---|---|---|
| 2,438,877 | | 3/1948 | Spruance, Jr. | 148/258 |
| 4,148,670 | | 4/1979 | Kelly | 148/247 |
| 5,246,507 | * | 9/1993 | Kodama et al. | 148/247 |
| 5,391,240 | * | 2/1995 | Seidel et al. | 148/247 |
| 5,449,414 | * | 9/1995 | Dolan | 148/247 |
| 5,449,415 | * | 9/1995 | Dolan | 148/247 |
| 5,707,465 | | 1/1998 | Bibber | 148/273 |
| 5,728,233 | * | 3/1998 | Ikeda et al. | 148/247 |
| 5,759,244 | * | 6/1998 | Tomlinson | 106/14.14 |

FOREIGN PATENT DOCUMENTS

| | | |
|---|---|---|
| 1 521715 | 2/1970 | (DE) . |
| 4 031710 | 4/1992 | (DE) . |
| 52-131937 | 11/1977 | (JP) . |
| 56-136978 | 10/1981 | (JP) . |
| 57-041376 | 3/1982 | (JP) . |
| 3-240971 | 10/1991 | (JP) . |
| 97 02369 | 1/1997 | (WO) . |

OTHER PUBLICATIONS

JP 57–41376—Derwent abstract only—Accession No. 1982–30092E[15], Derwent Classes M14 (English) (No Month).

JP H8–144063—Derwent abstract only—Accession No. 1996–319363[32], Derwent Classes M14 (English) (No Month).

Patent Abstracts of Japan—vol. 1996, No. 10, Oct. 31, 1996—publication No. 08–144063 (Takatani Matsufumi); publication date Jun. 4, 1996.

* cited by examiner

*Primary Examiner*—Deborah Jones
*Assistant Examiner*—Robert R. Koehler
(74) *Attorney, Agent, or Firm*—Wayne C. Jaeschke; Stephen D. Harper; Norvell E. Wisdom, Jr.

(57) ABSTRACT

A chromium-free water-based surface treatment liquid which contains from 0.01 to 50 g/l of a total of dissolved manganic acid, permanganic acid, and salt(s) thereof and from 0.01 to 20 g/l of a total of dissolved titanium compounds and has a pH of from 1.0 to 6.0 reacts rapidly with aluminum and aluminum alloy surfaces to deposit thereon a protective coating that does not contain hexavalent chromium and has excellent corrosion resistance and paint film holding properties.

19 Claims, No Drawings

WATER-BASED LIQUID TREATMENT FOR ALUMINUM AND ITS ALLOYS

FIELD OF THE INVENTION

This invention concerns a novel liquid for the surface treatment of aluminum or aluminum alloy materials for imparting superior corrosion resistance and paint film holding properties to such surfaces. Fields in which the invention can be used with particular effectiveness include the surface treatment of aluminum heat exchanger fins and aluminum alloy coils and sheets.

RELATED ART

The liquids used for the surface treatment of aluminum and aluminum alloy materials can be broadly classified as being of the chromate type or the non-chromate type. Chromic acid chromate forming treatment liquids and phosphoric acid chromate forming treatment liquids can be cited as typical examples of chromate type treatment liquids.

Chromic acid chromate forming treatment liquids have been in practical use since about 1950 and today they are widely used for the surface treatment of heat exchanger fins, aluminum wheels, building materials and aircraft materials. These chromic acid chromate forming treatment liquids contain chromic acid and fluoride as a reaction promotor as essential components, and a formed film which contains some hexavalent chromium is obtained on the metal material surface.

Phosphoric acid chromate forming treatment liquids are an invention disclosed in U.S. Pat. No. 2,438,877; they contain chromic acid, phosphoric acid and hydrofluoric acid as the main components, and a formed film which has hydrated chromium phosphate as the main component is obtained on the metal material surface. No hexavalent chromium is included in this formed film. Therefore these materials are being widely used at the present time as a paint undercoating treatment for the bodies and lids of beverage cans.

Although a formed film which has been obtained with such a surface treatment liquid of the chromate type has excellent corrosion resistance and paint film holding properties, harmful hexavalent chromium is contained in the treatment liquid and so the use of a treatment liquid which does not contain hexavalent chromium at all is desirable in terms of avoiding environmental problems.

The method disclosed in Japanese Unexamined Patent Application (Kokai) 52-131937 can be cited as a typical invention of a non-chromate type surface treatment liquid. This surface treatment liquid is an acidic aqueous coating solution, with a pH from about 1.5 to about 4.0, which contains zirconium or titanium or a mixture of the two, phosphate and fluoride. A formed film which has zirconium or titanium oxide as the main component is obtained on the metal surface when a metal surface is treated with such a surface treatment liquid. The non-chromate type surface treatment liquids do have the advantage of not containing hexavalent chromium, and they are widely used at present for the surface treatment of drawn-and-ironed (hereinafter usually abbreviated as "DI") aluminum cans, but there is a disadvantage in that the corrosion resistance of the film which is formed is not as good as that of a chromate film.

Furthermore, the method of treatment disclosed in Japanese Unexamined Patent Application (Kokai) 57-41376 involves the surface treatment of the surface of aluminum, magnesium, or an alloy of these metals, using an aqueous solution which contains one type, or two or more types, of titanium salt or zirconium salt and one type, or two or more types, of imidazole derivative.

The corrosion resistance of the film, according to the illustrative examples, is such that there is no rusting in 48 hours when tested in accordance with JIS-Z-2371. However, although this performance was satisfactory 15 years ago, it cannot be said to be truly adequate at the present time. This specification also indicates that oxidizing agents such as nitric acid or hydrogen peroxide or potassium permanganate can be used as well, being added in amounts, calculated as compounds, of from 0.01 to 100 grams per liter (hereinafter usually abbreviated as "g/l"), but there are no illustrative examples of oxidizing agents such as potassium permanganate.

Furthermore, a method of surface treatment whereby a formed film is obtained on the surface of an aluminum material with an aqueous solution which contains potassium permanganate or potassium manganate, or both of these materials, and mineral acid ($HNO_3$, $H_2SO_4$, HF), alkali (KOH, NaOH, $NH_4OH$), neutral fluoride (KF, NaF), acidic fluoride ($NH_4HF_2$, $NaHF_2$, $KHF_2$), silicofluoride ($MnSiF_6$, $MgSiF_6$) and the like has been disclosed in Japanese Unexamined Patent Application (Kokai) H8-144063. However, a corrosion resistance similar to or better than that of a chromate film cannot be anticipated when long term corrosion resistance tests are carried out with formed films which had been obtained with this liquid.

As indicated above, the problems of the corrosion resistance of the film which is formed and the treatment of the waste surface treatment liquid, for example, remain when the aforementioned conventional non-chromate type surface treatment liquids are used. From this viewpoint, the non-chromate type surface treatment liquids are hardly being used at all at the present time on the surface treatment part of manufacturing lines for aluminum based metal coils and sheets and the aluminum fins for heat exchanges, where especially good corrosion resistance is required.

Hence, at the present time the prior art does not provide any surface treatment liquid, for aluminum or aluminum alloy materials, which does not contain hexavalent chromium, which has excellent effluent treatment properties and with which a formed film which has excellent corrosion resistance and paint film adhesion properties is obtained.

PROBLEM TO BE SOLVED BY THE INVENTION

The present invention is intended to resolve the problems described above which are associated with the prior art, and in practical terms it is intended to provide a surface treatment liquid with which a film comprising specified metals can be obtained on an aluminum or aluminum alloy material surface and which can impart excellent corrosion resistance and paint film holding properties.

SUMMARY OF THE INVENTION

It has been discovered that it is possible to obtain a formed film which has excellent corrosion resistance and paint film adhesion properties on an aluminum or aluminum alloy surface by using a surface treatment liquid of pH from 1.0 to 6.0 which contains a prescribed amount of permanganic acid or one or more of its salt(s) and a prescribed amount of at least one type of compound selected from among water soluble titanium compounds and water soluble zirconium compounds, and the invention is based upon this discovery.

More particularly, a surface treatment liquid of this invention is a water-based liquid which contains from 0.01 to 50 g/l of permanganic acid and/or its salts, and from 0.01 to 20 g/l of at least one compound selected from among water soluble titanium compounds and water soluble zirconium compounds, and which has a pH of from 1.0 to 6.0.

DETAILED DESCRIPTION OF THE INVENTION

In this invention it is important that a complex film comprising compounds of two or more metal elements and which includes manganese, such as manganese and titanium, manganese and zirconium or manganese, titanium and zirconium, is formed, and the corrosion resistance of the formed film which is obtained is improved by this means.

Permanganic acid and/or its salts can be used to introduce the acid(s) and/or salt(s) thereof into a surface treatment liquid of this invention, and no narrow limitation is imposed upon the particular type of material used. The total concentration of permanganic acid and salt(s) thereof must be within the range from 0.01 to 50 g/l, and preferably is within the range from 0.05 to 20 g/l. A formed film may be obtained even if the concentration of permanganic acid and/or salt(s) thereof is less than 0.01 g/l, but this is undesirable, because the corrosion resistance and paint film adhesion properties of any such film are poor. A good formed film is obtained with a concentration of more than 50 g/l, but the properties of the film are no better than with 50 g/l, the cost of the treatment liquid is increased, and this is economically wasteful.

One type, or two or more types, of compound selected from among the sulfates, oxysulfates, acetates, ammonium salts and fluorides, for example, of titanium and zirconium can be used to introduce the water soluble titanium compound or water soluble zirconium compound into a surface treatment liquid of this invention, and no limitation is imposed on the type of compound, provided that it is water soluble. Furthermore, the amount included must be within the range from 0.01 to 20 g/l, and preferably within the range from 0.1 to 3 g/l. A formed film can be obtained even if the water soluble titanium compound or water soluble zirconium compound content is less than 0.01 g/l, but this is undesirable since the corrosion resistance of any such film is poor. A good formed film is obtained with more than 20 g/l, but the properties of the film are no better than with 20 g/l, the cost of the treatment liquid is increased and this is economically wasteful.

The pH of a surface treatment liquid of this invention must be within the range from 1.0 to 6.0 and is preferably within the range from 2.0 to 5.0. Excessive etching of the metal material surface occurs at a pH less than 1.0 and irregularities arise in the appearance; this is undesirable. Furthermore, if the pH exceeds 6.0, then it may become difficult to obtain a formed film which has excellent corrosion resistance, and there are cases where problems arise with the stability of the liquid, because the metal ions which are contained in the treatment liquid are likely to form a precipitate; this is undesirable. Acids such as nitric acid, sulfuric acid, phosphoric acid, hydrofluoric acid and fluorosilicic acid and alkalies such as sodium hydroxide, sodium carbonate, potassium hydroxide and ammonium hydroxide can be used, as required, when adjusting the pH of a surface treatment liquid of this invention to within the range from 1.0 to 6.0.

Moreover, in those cases where the metal substrate in this invention is an aluminum alloy which contains copper, iron, magnesium or the like, the stability of the treatment liquid is markedly reduced by metal ions, such as copper and/or magnesium ions, derived from the metal component which are dissolved in the surface treatment liquid, so that in this instance organic acids such as gluconic acid, heptogluconic acid, oxalic acid, tartaric acid, organophosphonic acid, ethylenediamine tetra-acetic acid and the alkali metal salts of these acids may advantageously be added as chelating agents to chelate these alloy component metals.

Furthermore, tungstic acid, molybdic acid and their salts, and water soluble organic peroxides such as tert-butylhydroperoxide, which has the chemical formula $(CH_3)_3C—OOH$, can be used conjointly in order to promote the formation of a film in this invention.

The formed films which are obtained by the method described above are comprised of manganese and at least one species selected from among titanium and zirconium as structural components, and the ratio by weight of Mn/(Ti+Zr) is preferably within the range from 0.1 to 20.0:1.0, and more preferably within the range from 0.2 to 5.0:1.0. The mass per unit area of the formed film of these metals independently preferably is from 5 to 500 milligrams per square centimeter of surface coated (hereinafter usually abbreviated as "$mg/m^2$").

The manganese, titanium and zirconium which are the structural components of a formed film of this invention are unlimited in terms of the chemical characteristics with which they are present in the film, and they may be present, for example, as the metals, oxides or phosphates.

Next, the method of treating aluminum or aluminum alloy material using a surface treatment liquid of this invention will be described.

A surface treatment liquid of this invention is preferably used in a process sequence such as follows below:

(1) Surface Clean: Degreasing (with an acid, an alkali or a solvent system)
(2) Water rinse
(3) Surface treatment with a treatment liquid of the invention
(4) Water rinse
(5) Rinse with deionized water
(6) Drying.

Independently, a surface treatment liquid of this invention is preferably brought into contact with the surface of the aluminum or aluminum alloy material at a temperature of from 20 to 80° C. for a period of from 1 to 120 seconds. At contact temperatures below 20° C., the reactivity between the treatment liquid and the metal surface is low, so that a good formed film is not usually obtained, and if the temperature exceeds 80° C., a formed film is obtained but the energy costs are high and this is economically wasteful. Furthermore, reaction is usually inadequate with a treatment time of less than 1 second, so that a formed film which has excellent corrosion resistance is not obtained. On the other hand, no improvement in the corrosion resistance and paint film adhesion properties of the formed film obtained have been seen if the contact time exceeds 120 seconds.

Moreover, any method of contacting the substrate being treated with the surface treatment liquid, such as an immersion method or a spraying method, can be used in this invention.

The amount of formed film deposited on the surface of an aluminum or aluminum alloy material by means of the method of this invention preferably contains from 5 to 300 $mg/m^2$ of manganese and from 3 to 100 $mg/m^2$ of titanium, zirconium, or both. If the amount of deposited manganese is less than 5 $mg/m^2$, the corrosion resistance and paint film adhesion properties of the formed film obtained usually are inadequate, and if this amount exceeds 300 $mg/m^2$, it is undesirable in terms of the irregularity of the appearance of the formed film which is obtained. Furthermore, if the amount of deposited titanium and/or zirconium is less than 3 $mg/m^2$, the corrosion resistance of the formed film which is obtained is usually inadequate, and if the amount exceeds 100 $mg/m^2$, a formed film which has excellent corrosion resistance, but one which is no better than that obtained at 100 $mg/m^2$, is obtained; this is economically wasteful.

Aluminum or aluminum alloy materials which may be surface treated by means of the method of this invention include pure aluminum and aluminum alloys, and the aluminum alloys include alloys such as Al—Cu, Al—Mn, Al—Mg and Al—Si alloys, for example. Furthermore, no limitation is imposed upon the shape or dimensions of the aluminum or aluminum alloy material with which the method of the invention is used, and the forms include sheets and various moldings, for example.

Illustrative examples, which are not to be construed as limiting the invention, are described along with comparative examples below, and the effect of a surface treatment liquid of this invention is described in more detailed terms.

Substrate Used in the Tests

Al—Mn alloy sheet according to Japanese Industrial Standard (hereinafter usually abbreviated as "JIS") 3004 was used. Dimensions: 150 mm×70 mm, Thickness 0.2 mm.

Treatment Conditions

The treatment was carried out in the process order (1)→(2)→(3)→(4)→(5)→(6) as detailed below, and a surface treated sheet was obtained.

(1) Degreasing: (60° C., 60 seconds, immersion method) A 3% aqueous solution of a commercial alkaline degreasing agent (registered trade name: FineCleaner® 315, manufactured by the Nihon Parkerizing Co.) was used.

(2) Water rinse (Normal ambient human comfort temperature, 10 seconds, spray method)

(3) Forming Treatment (immersion method)

The substances used as the sources of manganese, zirconium, and titanium and for pH adjustment in Examples 1 to 5 and Comparative Examples 1 to 4 are shown in Table 1, which also contains identifying letters and numbers that are used as abbreviations in the next table.

TABLE 1

| Component | Source |
|---|---|
| Water Soluble Manganese Compound | a: Manganese sulfate (i.e., $MnSO_4.H_2O$)<br>b: Potassium manganate (i.e., $K_2MnO_4$)<br>c: Potassium permanganate (i.e., $KMnO_4$) |
| Water Soluble Titanium Compound | A: 40% Fluorotitanic acid (i.e., $H_2TiF_6$) solution in water<br>B: 24% Titanium sulfate (i.e., $Ti(SO_4)_2$) solution in water |
| Water Soluble Zirconium Compound | i: 20% fluorozirconic acid (i.e., $H_2ZrF_6$) solution in water<br>ii: Ammonium fluorozirconate (i.e., $(NH_4)_2ZrF_6$) |
| pH Adjusting Agent | I: 67.5% nitric acid (i.e., $HNO_3$) solution in water<br>II: 40% fluorosilicic acid (i.e., $H_2SiF_6$) solution in water<br>III: 25% ammonia (i.e., $NH_3$) solution in water |

Surface treatment was carried out with the composition and under the treatment conditions shown in Table 2, in which the amount of each substance indicated in a treatment liquid composition column in Table 2 by an identifying letter or number from Table 1 is the amount of the corresponding pure active ingredient as shown in Table 1.

Also, the surface treatment conditions for Comparative Examples 5 to 7 are indicated below.

(4) Water Rinse (Normal ambient human comfort temperature, 30 seconds, immersion method)

(5) Rinse with Deionized Water (Normal ambient human comfort temperature, 30 seconds, immersion method)

(6) Heating and Drying (80° C., 3 minutes, hot forced air oven)

TABLE 2

COMPOSITION AND PROCESS CONDITIONS AND RESULTS OF EVALUATION TESTS

| | Composition of the Forming Treatment Liquid (g/l) | | | | | | | | Treatment Conditions | |
|---|---|---|---|---|---|---|---|---|---|---|
| Example Number | Mn Source(s) and Amounts | | Ti Source and Amount | | Zr Source and Amount | | pH Adjusting Agent | pH | Temperature, ° C. | Time, Seconds |
| 1 | a | 1.0 | - | - | i | 0.3 | III | 4.5 | 60 | 60 |
| | b | 10.0 | | | | | | | | |
| | c | 0.5 | | | | | | | | |
| 2 | b | 3.0 | A | 0.9 | - | - | - | 2.6 | 35 | 120 |
| | c | 3.0 | | | | | | | | |
| 3 | c | 5.0 | B | 0.8 | - | - | I | 2.4 | 50 | 30 |
| 4 | c | 5.0 | - | - | i | 0.1 | II | 3.5 | 60 | 60 |
| 5 | a | 1.0 | A | 0.1 | ii | 0.1 | III | 3.5 | 70 | 10 |
| | c | 1.0 | | | | | | | | |
| Comp.1 | c | 10.0 | - | - | - | - | I | 2.0 | 60 | 60 |
| Comp.2 | - | - | - | - | i | 0.3 | - | 3.0 | 60 | 60 |
| Comp.3 | b | 10.0 | A | 0.008 | - | - | I II | 3.8 | 60 | 60 |
| Comp.4 | a | 0.93 | A | 1.0 | - | - | III | 3.0 | 60 | 60 |
| Comp.5 | - | - | - | - | - | - | - | 2.9 | 10 | 30 |
| Comp.6 | - | - | - | - | - | - | - | 1.6 | 40 | 60 |
| Comp.7 | - | - | - | - | - | - | - | 1.6 | 50 | 20 |

TABLE 2-continued

COMPOSITION AND PROCESS CONDITIONS AND RESULTS OF EVALUATION TESTS

| Example Number | Film Contents, mg/m² of Mn | Ti | Zr | Cr | Ratio by Weight, Mn: (Ti + Zr) | Film Mass, mg/m² of (Mn + Ti + Zr) | Corrosion Resistance SST, 1000 Hours | Adhesion Properties, % of Squares Remaining |
|---|---|---|---|---|---|---|---|---|
| 1 | 5 | - | 30 | - | 0.17 | 35 | ◎ | 100 |
| 2 | 110 | 80 | - | - | 1.38 | 190 | ◎ | 98 |
| 3 | 28 | 12 | - | - | 2.33 | 40 | ○ | 96 |
| 4 | 68 | - | 8 | - | 8.50 | 76 | ○ | 99 |
| 5 | 60 | 12 | 45 | - | 0.88 | 107 | ◎ | 100 |
| Comp. 1 | 55 | - | - | - | n.m. | n.m. | Δ | 98 |
| Comp. 2 | - | - | 45 | - | n.m. | n.m. | X | 75 |
| Comp. 3 | 48 | 3 | - | - | 16.00 | 51 | Δ | 99 |
| Comp. 4 | 3 | 38 | - | - | 0.08 | 41 | X | 82 |
| Comp. 5 | - | - | 15 | - | n.m. | n.m. | X | 100 |
| Comp. 6 | - | - | - | 170 | n.m. | n.m. | ◎ | 99 |
| Comp. 7 | - | - | - | 70 | n.m. | n.m. | ○ | 100 |

Abbreviations and Other Note for Table 2

"Comp" means "Comparison"; "n.m." means "not measured". A hyphen entry in a cell indicates that none of the material in the column heading for the cell in question was deliberately added.

COMPARATIVE EXAMPLE 5

A 7% aqueous solution of a commercial zirconium phosphate based surface treating agent (registered trade name: Arochrome® 713, manufactured by the Nihon Parkerizing Co.) was used for the forming treatment. The liquid was used at a temperature of 40° C. for a contact time of 60 seconds by immersion, to treat the aforementioned Al—Mn based alloy sheet.

COMPARATIVE EXAMPLE 6

A 7% aqueous solution of a commercial chromic acid chromate forming treatment agent (registered trade name: Alchrome® 713, manufactured by the Nihon Parkerizing Co.) was used for the surface treatment. The liquid was used under the same process conditions to treat the same Al—Mn based alloy sheet as in Comparative Example 5.

COMPARATIVE EXAMPLE 7

A 3% aqueous solution of a commercial phosphoric acid-chromate forming treatment agent (an aqueous solution of a mixture of 4% of a product with the registered trade name Alchrome® K702SL, and 0.3% of a product with the registered trade name Alchrome® K702AC 0.3%, both manufactured by the Nihon Parkerizing Co.) was used for the surface treatment. The liquid was used at a temperature of 50° C. for a contact time of 20 seconds, using a spray method, to treat the same type of Al—Mn based alloy sheet as in Comparative Examples 5 and 6.

Methods of Evaluation (1) Amount Deposited

The amounts of Mn, Ti, Zr and/or Cr in the films were measured using fluorescence X-ray diffraction apparatus.

(2) Corrosion Resistance

A salt water spray test in accordance with JIS Z-2371 was used to evaluate corrosion resistance. The state of corrosion of the surface treated sheet after salt water spraying for 1,000 hours was assessed visually and is reported by using the following symbols:

◎: Corroded area less than 10%;

○: Corroded area at least 10% but less than 50%;

Δ: Corroded area at least 50% but less than 90%; and

X: Corroded area at least 90%.

(3) Paint Film Adhesion Properties

An epoxy-phenol based can-lid paint was applied to a paint film thickness of 5 micrometers on the surface of the Al—Mn based alloy sheets which had been surface treated under the conditions of Examples 1 to 5 and Comparative Examples 1 to 7, and was then baked for 3 minutes at 220° C. Next, 100 squares of width 2 mm were cut with a scriber in the middle part of the painted sheet and the sheets were immersed in deionized boiling water for 60 minutes. Then, the painted sheet was dried and subjected to cellophane tape peeling test, and the paint film adhesion properties were evaluated by means of the remaining number of squares which had not peeled off with the tape. In this test, a larger number of squares remaining signifies superior paint film adhesion properties and a number of 98 or above remaining indicates performance which is satisfactory for even very demanding practical uses. The results of the evaluations are shown in Table 2.

It is clear from Table 2 that the formed films obtained with the treatment liquids of this invention had similar corrosion resistance to those obtained with a commercial chromic acid chromate or phosphoric acid chromate treatment, and that excellent corrosion resistance can be realized by forming a complex film with appropriate amounts of Mn and Ti/Zr.

Benefits of the Invention

As is clear from the description above, it is possible to obtain a formed film which has excellent corrosion resistance and paint film adhesion properties and which does not contain hexavalent chromium by applying a surface treatment liquid of this invention to an aluminum or aluminum alloy substrate. Hence, the aluminum or aluminum alloy material surface treatment liquids of this invention are very effective in practice.

What is claimed is:

1. A liquid composition suitable for the surface treatment of aluminum and aluminum alloy substrate surfaces, said composition having a pH value in a range from 1.0 to 6.0 and comprising water and the following components (A) and (B):

(A) a concentration of from 0.01 to 50 g/l of solute molecules selected from the group consisting of permanganic acid and its salts; and (B) a concentration of from 0.01 to 20 g/l of solute molecules selected from titanium compounds and zirconium compounds.

2. A composition according to claim 1, wherein the concentration of component (A) is from 0.05 to 20 g/l.

3. A composition according to claim 2, wherein the concentration of component (B) is from 0.1 to 3 g/l.

4. A composition according to claim 3 that has a pH value from 2.0 to 5.0.

5. A composition according to claim 2 that has a pH value from 2.0 to 5.0.

6. A composition according to claim 1 that has a pH value from 2.0 to 5.0.

7. A process for forming a protective coating, which contains manganese and at least one of titanium and zirconium, on an aluminum or aluminum alloy substrate surface, said process comprising an operation of contacting said substrate surface with a composition according to claim 4 at a temperature and for a time interval that are sufficient to result in formation over said substrate of said protective coating that contains an amount of manganese and an amount of a total of titanium and zirconium, said protective coating being sufficiently adherent to said substrate surface that it is not removed by being rinsed with water at a temperature of 25° C.

8. A process according to claim 7 wherein said temperature is in a range from 20 to 80° C. and said time is in a range from 1 to 120 seconds.

9. A process according to claim 8 wherein the protective coating formed has a mass per unit area that is from 5 to 500 $mg/m^2$.

10. A process according to claim 9 wherein said mass per unit area includes from 5 to 300 $mg/m^2$ of manganese and from 3 to 100 $mg/m^2$ of a total of titanium and zirconium.

11. A process according to claim 10, wherein the amount of manganese in said protective coating has a ratio to the amount of a total of zirconium and titanium in the same protective coating that is from 0.2 to 5.0:1.0.

12. An article of manufacture comprising a substrate consisting of aluminum or aluminum alloy and a protective coating thereover, said protective coating comprising from 5 to 300 $mg/m^2$ of manganese and from 3 to 100 $mg/m^2$ of a total of titanium and zirconium, said protective coating further being sufficiently adherent to said substrate surface that is not removed by being rinsed with water at a temperature of 25° C.

13. An article of manufacture according to claim 12 wherein the protective coating formed has a mass per unit area that is from 5 to 500 $mg/m^2$.

14. An article of manufacture according to claim 13 wherein the amount of manganese in said protective coating has a ratio to the amount of a total of zirconium and titanium in the same protective coating that is from 0.1 to 20:1.0.

15. A process for forming a protective coating, which contains manganese and at least one of titanium and zirconium, on an aluminum alloy substrate surface, said process comprising an operation of contacting said substrate surface with a composition according to claim 1 at a temperature and for a time interval that are sufficient to result in formation over said substrate of said protective coating that contains an amount of manganese and an amount of a total of titanium and zirconium, said protective coating being sufficiently adherent to said substrate surface that it is not removed by being rinsed with water at a temperature of 25° C.

16. A process according to claim 15, wherein said temperature is in a range from 20 to 80° C. and said time is in a range from 1 to 120 seconds.

17. A process according to claim 16, wherein the protective coating formed has a mass per unit area that is from 5 to 500 $mg/m^2$.

18. A process according to claim 17, wherein said mass per unit area includes from 5 to 300 $mg/m^2$ of manganese and from 3 to 100 $mg/m^2$ of a total of titanium and zirconium.

19. A process according to claim 18, wherein the amount of manganese in said protective coating has a ratio to the amount of a total of zirconium and titanium in the same protective coating that is from 0.1 to 20:1.00.

* * * * *

UNITED STATES PATENT AND TRADEMARK OFFICE

CERTIFICATE OF CORRECTION

PATENT NO. : 6,200,693 B1
DATED : March 13, 2001
INVENTOR(S) : Nakada et al.

It is certified that error appears in the above-identified patent and that said Letters Patent is hereby corrected as shown below:

Column 9,
Line 37, after "claim 7", insert -- , --.
Line 40, after "claim 8", insert -- , --.
Line 43, after "claim 9", insert -- , --.

Column 10,
Line 11, after "that", insert -- it --.
Line 22, after "aluminum" and before "alloy", insert -- or aluminum --.

Signed and Sealed this

Third Day of February, 2004

JON W. DUDAS
*Acting Director of the United States Patent and Trademark Office*